US008420988B2

(12) United States Patent
Geiger et al.

(10) Patent No.: US 8,420,988 B2
(45) Date of Patent: Apr. 16, 2013

(54) COOKTOP CONTROL PANEL MOUNTING ASSEMBLY

(75) Inventors: Joseph Geiger, Trent Woods, NC (US); Michael Gerdes, New Bern, NC (US); Troy Wilson, Cove City, NC (US); Mark Wood, New Bern, NC (US); Anthony Zymroz, Jr., Trenton, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 385 days.

(21) Appl. No.: 12/786,499

(22) Filed: May 25, 2010

(65) Prior Publication Data

US 2011/0290783 A1 Dec. 1, 2011

(51) Int. Cl.
*H05B 3/06* (2006.01)
*H05B 3/68* (2006.01)

(52) U.S. Cl.
USPC ..... 219/536; 219/452.11; 219/451.1; 248/121; 248/686; 248/693

(58) Field of Classification Search ..... 219/452.11, 219/536, 451.1; 126/211, 218; 16/87, 2, 16/114; 248/686, 693, 466, 475.01, 476, 248/489, 121
See application file for complete search history.

(56) References Cited

U.S. PATENT DOCUMENTS

| | | | | |
|---|---|---|---|---|
| 5,473,807 | A | 12/1995 | Tupa et al. | |
| 5,549,098 | A * | 8/1996 | Bales et al. | 126/211 |
| 5,813,395 | A * | 9/1998 | Taplan et al. | 126/214 A |
| 5,841,109 | A | 11/1998 | White et al. | |
| 6,794,621 | B1 * | 9/2004 | Brown et al. | 219/506 |
| 6,817,355 | B1 | 11/2004 | Hawkins et al. | |
| 6,888,107 | B2 | 5/2005 | McFarland | |
| 6,996,943 | B2 * | 2/2006 | Denier et al. | 52/220.7 |
| 2003/0183617 | A1 * | 10/2003 | Platt | 219/452.11 |

* cited by examiner

*Primary Examiner* — Colleen Matthews
*Assistant Examiner* — Galina Yushina
(74) *Attorney, Agent, or Firm* — James E. Howard; Andre Pallapies

(57) ABSTRACT

A domestic appliance includes a control panel and a control panel mounting bracket which includes a frame shaped for being installed on a surface panel of a domestic appliance. The surface panel has an opening therein for receiving the frame. The frame has an open portion for receiving a control mount adhered over the open portion. The surface panel has a top surface and a bottom surface, and the frame has a main securing member having at least one tab extending therefrom. The tab is bendable along a line off-set from vertical such that when the tab is bent, it bears against the bottom surface of the surface panel to urge the frame against the surface panel.

20 Claims, 6 Drawing Sheets

COOKTOP CONTROL PANEL MOUNTING ASSEMBLY

FIELD OF THE INVENTION

The present invention is directed to a domestic appliance having a control panel, and more particularly, to an easily replaceable control panel mounting bracket allowing for a control panel to be securely, but removeably, mounted within a domestic appliance such as a cooking appliance. The control panel mounting bracket of the present invention allows for easy replacement and repair of the control panel for the domestic appliance.

BACKGROUND OF THE INVENTION

In the field of domestic appliances, and in particular domestic cooking appliances, stainless metal upper surface panels which include, for example, burners mounted therein, also include a control panel which is mounted on the surface and typically permanently secured to the surface. The control panel can include control mechanisms/electronics underneath the surface, with openings in the panel for actuators to extend therethrough, and optionally with knobs attached to the actuators (such as for controlling operation of the burners). One problem with this type of arrangement is that if the control panel, which may include a glass control mount, is damaged, or if the stainless surface panel top is damaged, both items would have to be discarded due to the fact that the control panel is tightly adhered to the surface panel. This results in unnecessary waste.

One alternative prior art system provides a device and method of attaching a face plate assembly to a domestic appliance. The face plate includes supporting legs on a back surface of the face plate which fit within a channel created on the back of the surface upon which the face plate is to be mounted. However, a problem with such an arrangement is that in order to be easily assembled, the tolerances are wide and complex arrangements with screws or other securing devices are required to keep the face plate assembly immovable against the surface upon which it is mounted.

In accordance with the present invention, these problems with the prior art control panel mounting arrangements are avoided by providing a domestic appliance, a control panel, and mounting bracket for the control panel which allows ease of assembly and replacement of individual parts without requiring disposing of the entire assembly when one or more parts of the assembly are damaged.

SUMMARY OF THE INVENTION

In accordance with one aspect of the invention, there is provided a control panel mounting bracket for a domestic appliance. The bracket includes a frame shaped for being installed on a surface panel of a domestic appliance, the surface panel having an opening therein. The frame includes an open portion for receiving a control mount which is adhered over the open portion to the frame. The surface panel on which the frame is mounted has a top surface and a bottom surface. The frame includes a main securing member with at least one tab extending from the main securing member. The main securing member extends from the frame to be received within the opening in the surface panel. The tab is bendable to engage a bottom surface of the surface panel. More specifically, the tabs are weakened along a line off-set from vertical such that when the tabs are bent, they are moved to bear against the bottom surface of the surface panel to urge the frame against the surface panel.

In a more specific aspect, the main securing member includes a central portion extending substantially perpendicularly from the frame and at least one tab portion extending substantially planar from the central portion, and having a weakened connection along a line at which the tab is bent.

In a yet still more preferred aspect, the central portion has a greater vertical dimension than the tab, and the weakened connection is such that when the tab is bent, it moves in a direction to progressively bear against the bottom surface of the surface panel.

In another aspect, the invention relates to a control mount assembly for a domestic appliance including a frame as previously described. The control mount assembly also includes a control mount which is adhered to the frame over the open portion of the frame. The control mount has openings for allowing control members of a domestic appliance to project therethrough, for example, for having control knobs mounted thereon.

In yet still another aspect, the invention relates to a domestic appliance including such a frame and control mount assembly substantially as previously described wherein the control mount and frame assembly are removeably attached to the surface panel of the domestic appliance.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
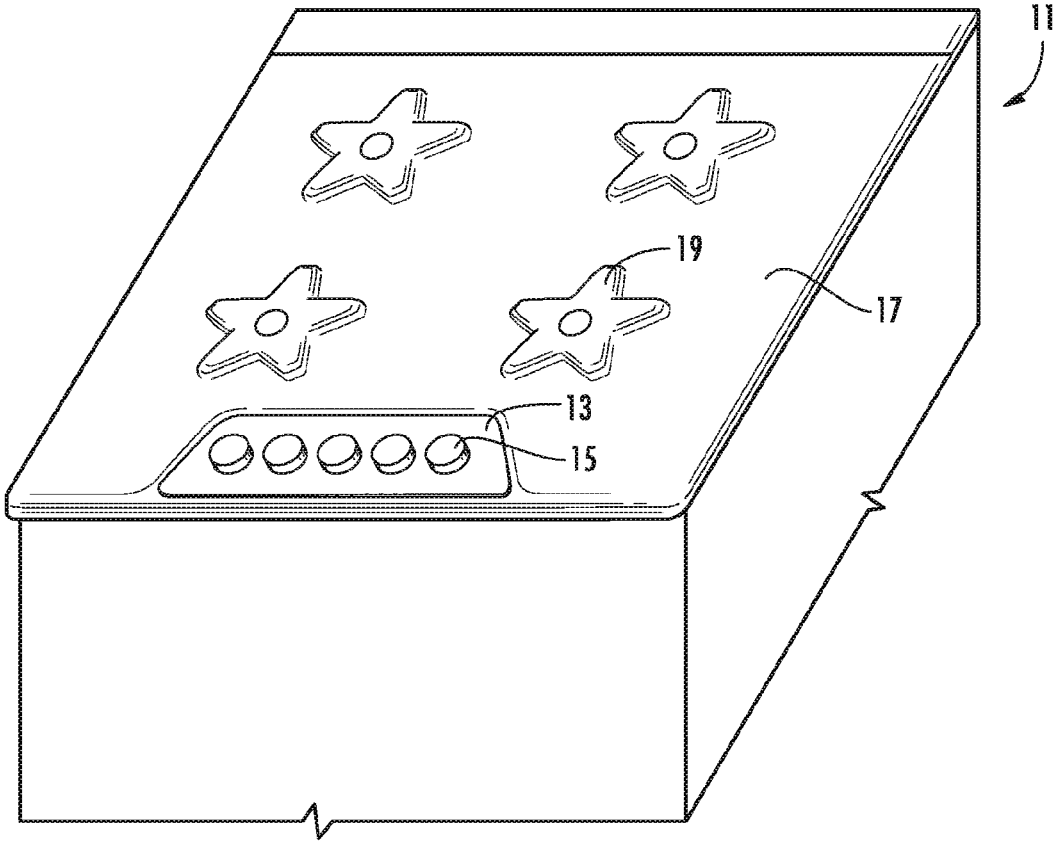
FIG. 1 is a perspective partial view of a domestic appliance, namely a cooking appliance, having burner mounts and a control panel on a surface panel thereof.

FIG. 1 illustrates in perspective view a domestic appliance 11 of the type with which the invention is employed. The domestic appliance 11 may be a cooking appliance with a surface panel 17, which may be a stainless metal panel with burner mounts 19 arranged thereon for mounting of burners in a conventional manner. A control panel assembly 13 is mounted on the surface panel 17, secured to an upper surface and a bottom surface 39 (see FIG. 3) for controlling the various components of the domestic appliance 11, for example, burners through actuation of knobs 15 which may be connected to controls for the domestic appliance 11, and which are housed within the domestic appliance, and controlled through the control panel assembly 13.

Figure 2:
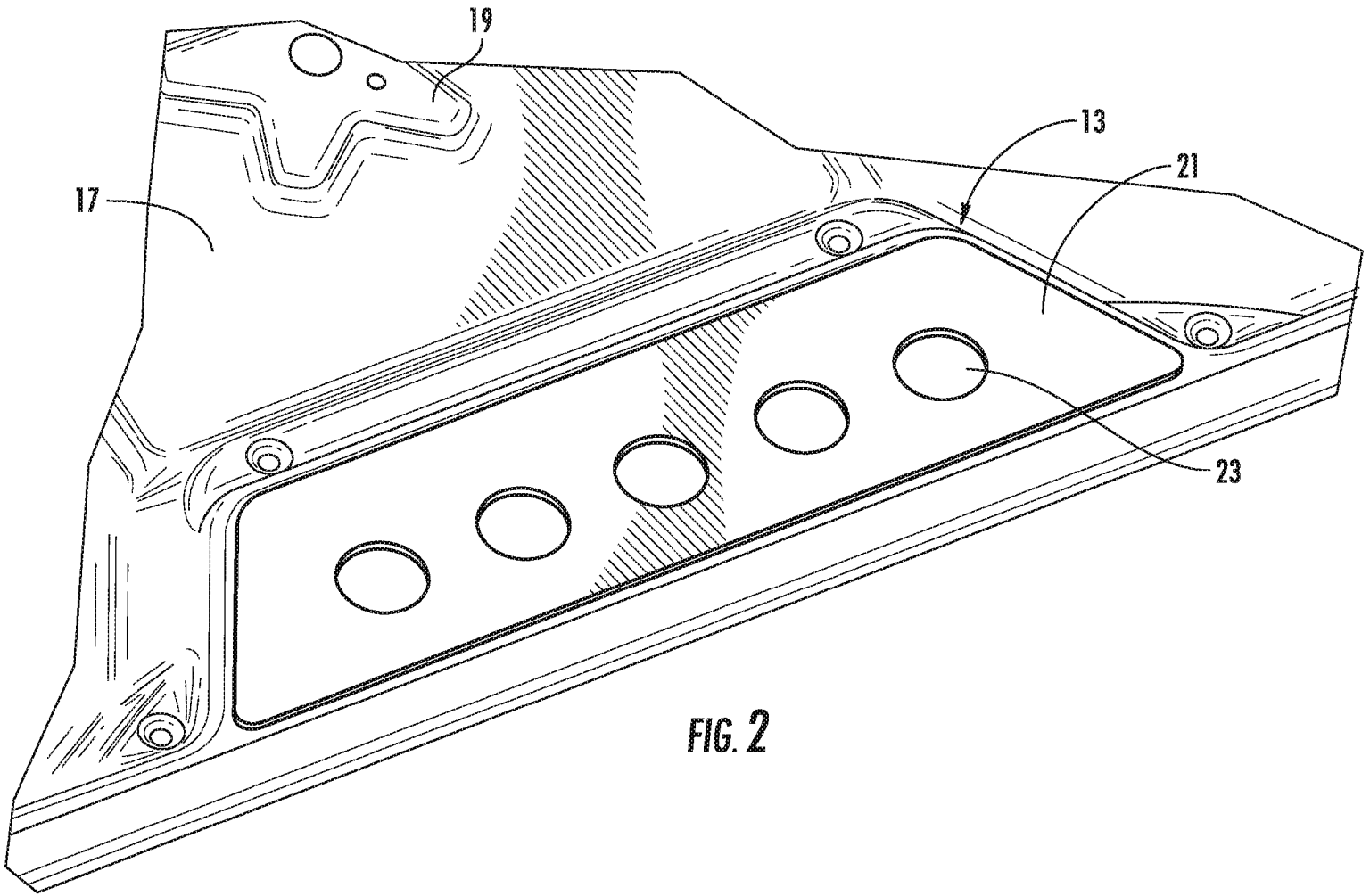
FIG. 2 is a partial view of a control panel installed in a surface panel of a domestic appliance.

FIG. 2 is an enlarged view of a portion of the domestic appliance 11 showing the control panel assembly 13 mounted on the surface panel 17 of the domestic appliance 11, and showing a partial view of a burner mount 19. The control panel assembly 13 includes a control mount 21, which may be a glass control mount, with openings 23 through which control members from a control device within the appliance 11 can project and may have, for example, knobs 15 as shown in FIG. 1, mounted thereon.

Figure 3:
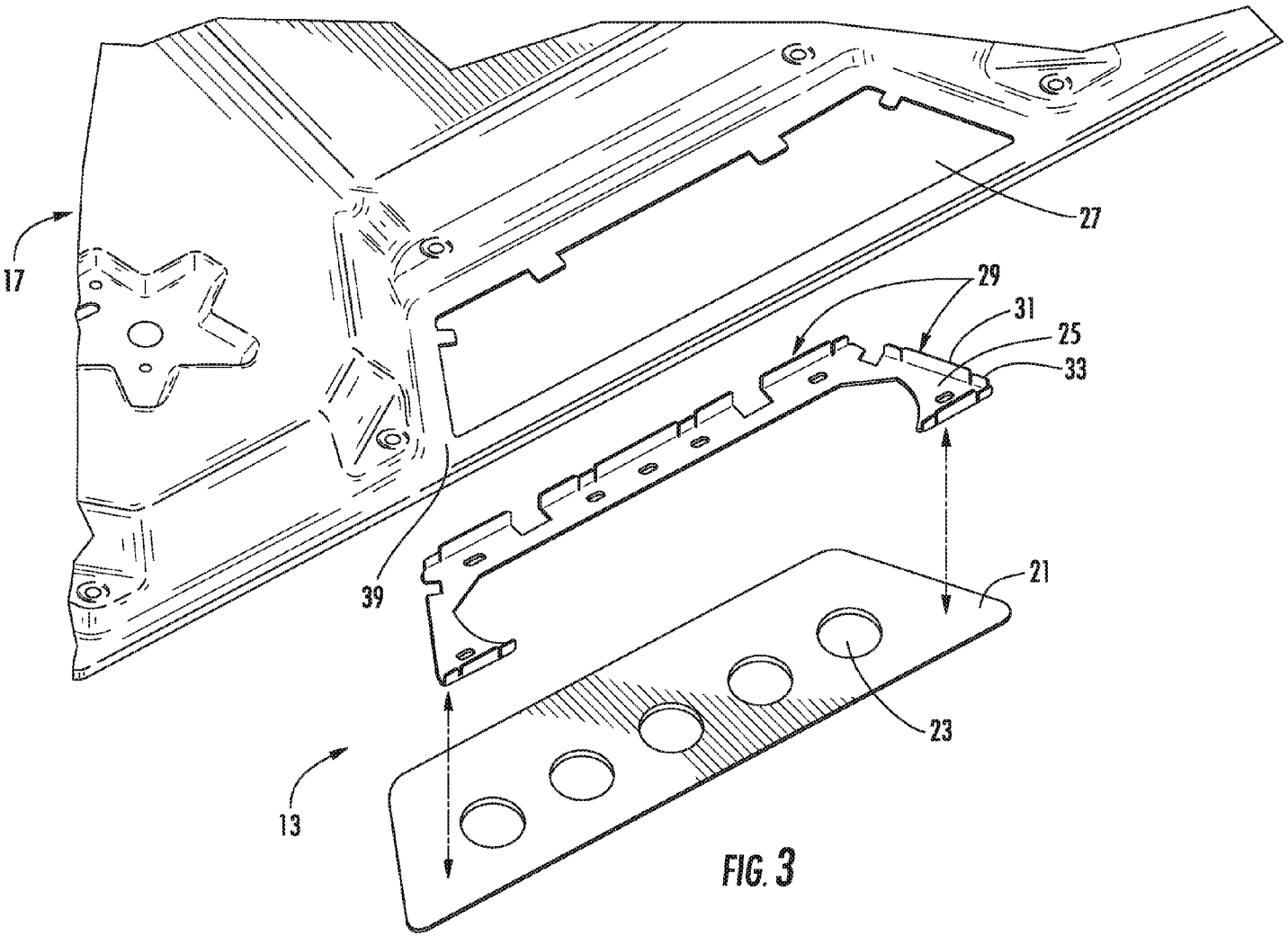
FIG. 3 is a view similar to that of FIG. 2, but from the bottom of the surface panel of a domestic appliance, showing the various components of the invention in exploded view.
Figure 4:
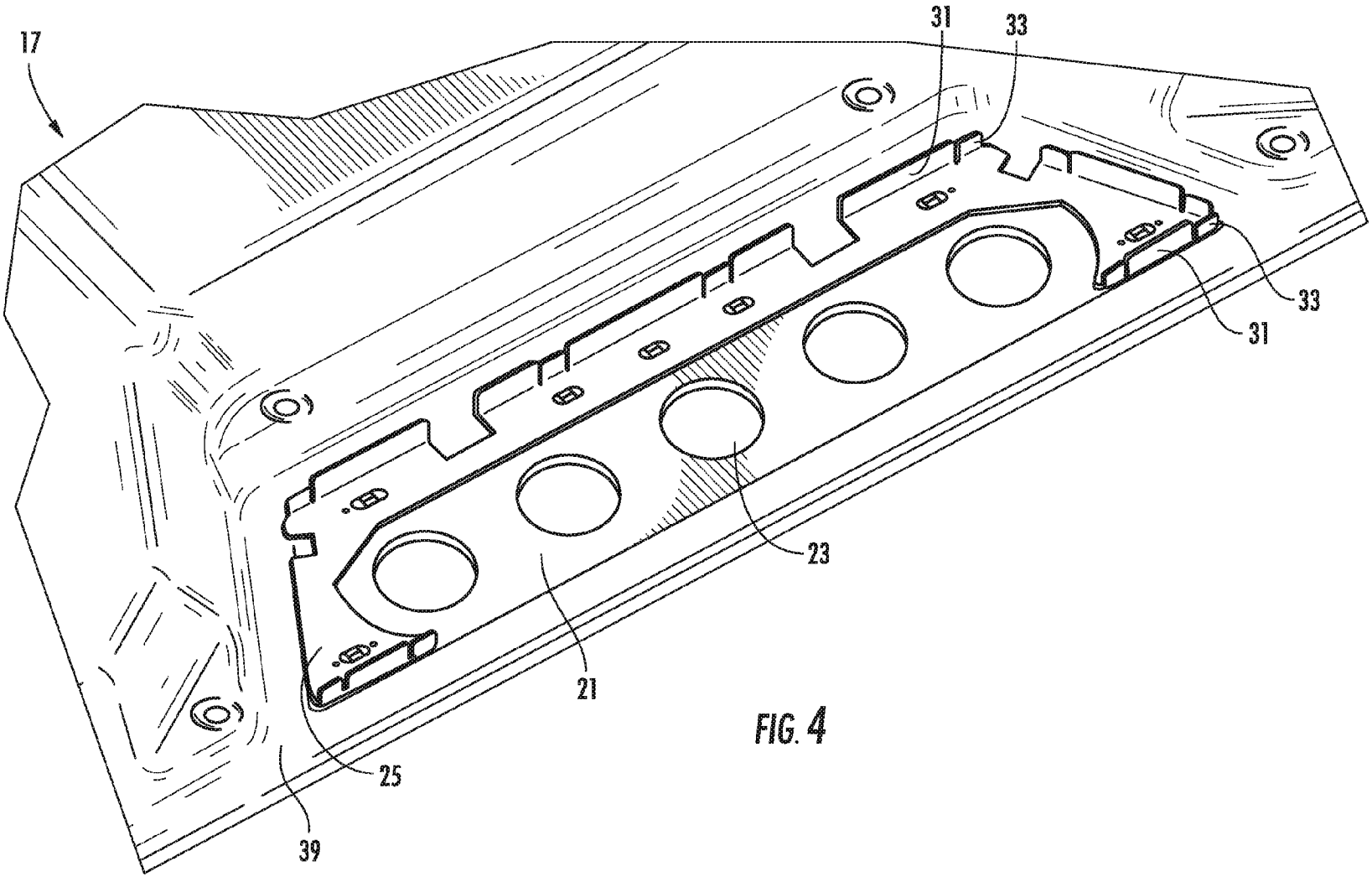
FIG. 4 is a view as in FIG. 3, but showing all of the elements of the invention mounted together but not secured.

The view in FIGS. 3 and 4 are bottom views of the surface panel 17 and show the bottom surface 39 of the surface panel 17. As shown in FIG. 3, the surface panel 17 includes an opening 27 for receiving the control panel assembly 13 mounted therein. A frame 25 is provided which is also partially open to allow control members to project through the frame 25 and through openings 23 of a control mount 21, such as a glass control mount, making up part of the control mount assembly 13. The control mount 21 may be adhered with tape or glue to the frame 25. The frame 25 includes tab assemblies 29 which included main securing members 31 with one or more tabs 33 extending on either side, or both sides of the main securing member 31. The main securing members 31 may be enlarged relative to the tabs 33 (see FIG. 6).

Figure 5:
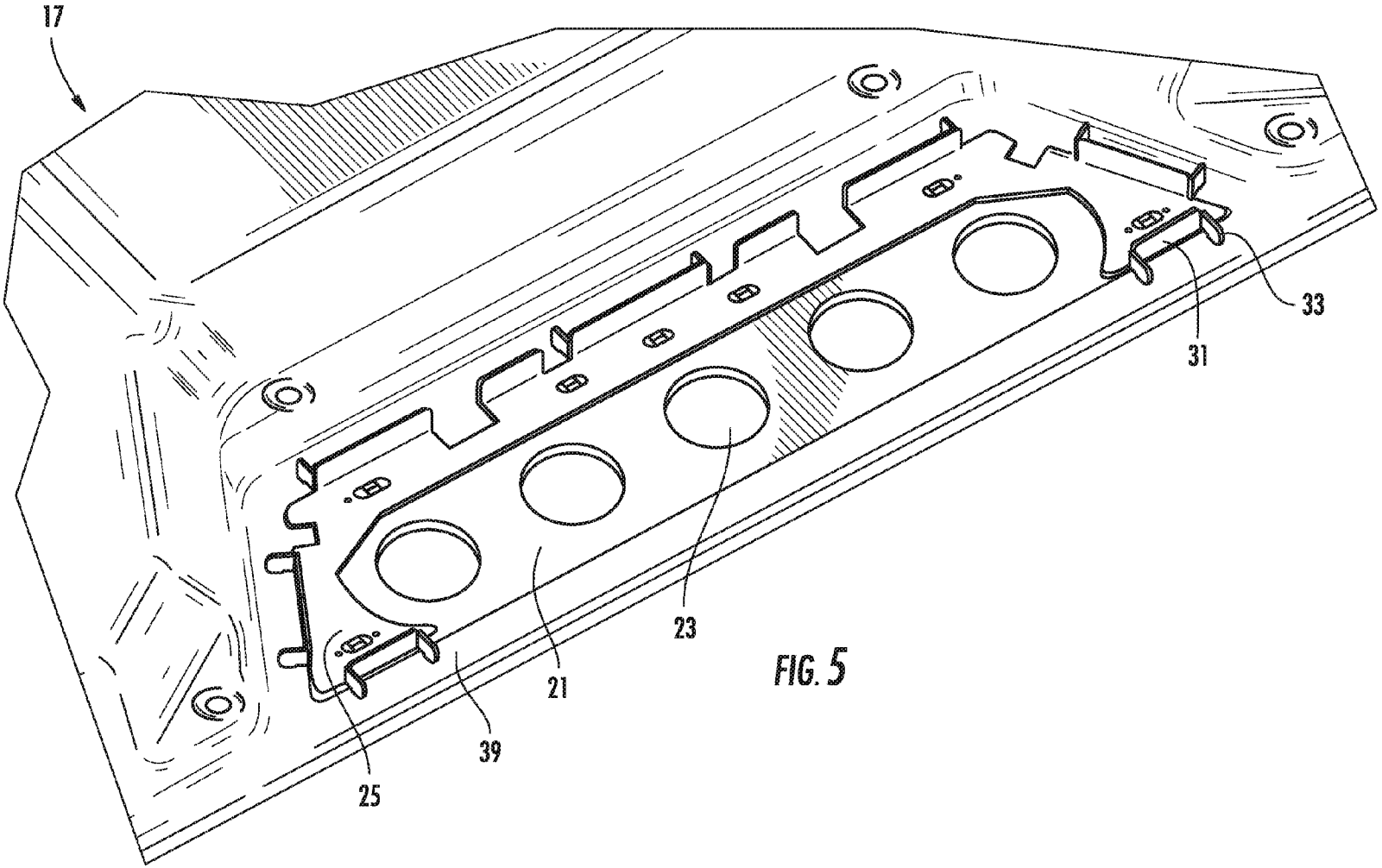
FIG. 5 is a view similar to FIG. 4, but showing the tabs of the main securing members of the invention bent for securing the control panel frame with a control mount fixed thereto, mounted onto the surface of the domestic appliance.

As shown in FIG. 5, which is a view similar to that of FIGS. 3 and 4, the frame 25 is received within the opening 27 (shown in FIG. 3) and the control mount 21 is adhered to the frame 25 by tape, glue or other means. In order to secure the frame 25 and control mount 21 to the surface panel 17, the tabs 33 are bent in a way in which the tabs 33 also move towards bottom surface 39 to engage the bottom surface 39 and to pull the frame 25 (and control mount 21 adhered thereto) down into the opening 27, and against the surface panel 17. The pull-down force is sufficient to seal (possibly also with use of a gasket, not shown) the control panel assembly 13 against the surface panel 17 to prevent intrusion of liquids therein.

Figure 6:
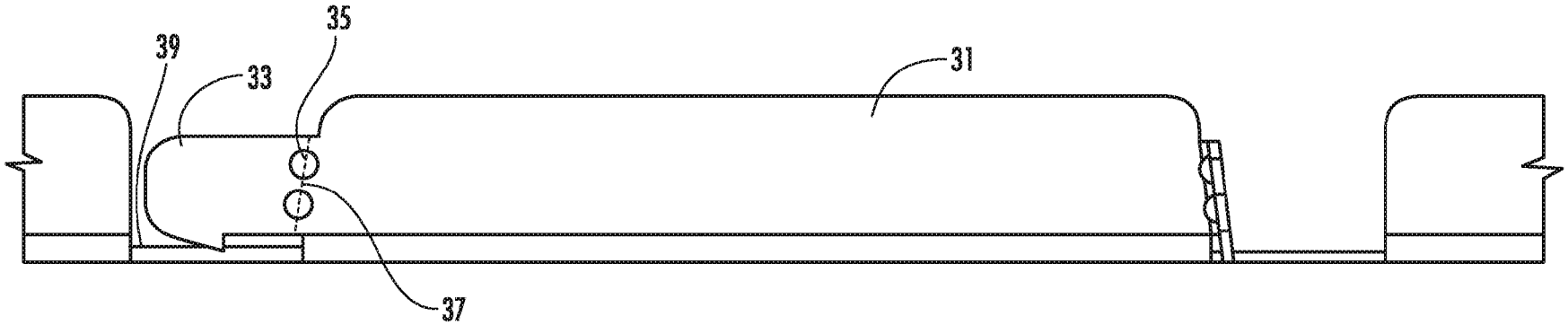
FIG. 6 is a side view of a main securing member showing details thereof, with one tab bent and the other tab in an unbent condition, to show its relationship relative to the bottom surface of a surface panel of the domestic appliance.

FIG. 6 shows in greater detail the securing arrangement in which main securing members 31 preferably have a height dimension which is greater than the height of the tabs 33. In terms of dimensions, in a preferred embodiment the main securing member 31 will have a height which is about 3 millimeters greater than the height of the tabs 33. Further, the tabs 33 are weakened at angled connections to the main securing members 31 to easily allow bending in the required direction to urge the control panel assembly against the surface panel. This is achieved by openings 35 which create a virtual weakened score line 37, which is at an angle, or set along a line off-set from vertical, such that when the tabs 33 are bent, they are urged against the bottom surface 39 of the surface panel 17 to pull the frame 25 into tighter contact with the surface panel 17. The additional height of the main securing member 31, which also typically has a specified width greater than the tabs 33, also prevents the member 31 from being bent as a result of bending of the tabs 33, and increases the structural stability of the arrangement and results in a higher pull-down force between the frame 25 and the surface panel 17. Accordingly, the additional height of the main securing member 31, along with the angled or off-set nature of the weakened score line, ensure that the tabs 33 are bent at the proper angle to ensure maximum pull-down force against the bottom surface 39 of the surface panel 17.

As may be appreciated, while stainless metal has been indicated to be preferred for some components of the invention, other equivalent materials may be employed as will be readily apparent to those of ordinary skill in the art.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

What is claimed is:

1. A control panel mounting bracket for a domestic appliance, comprising:

a frame shaped for being installed on a surface panel of a domestic appliance, the surface panel having an opening therein, and the frame having an open portion for receiving a control mount adhered over the open portion to the frame;

a main securing member having at least one tab extending from the main securing member, the main securing member extending from the frame for being received into the surface panel, and the surface panel having a top surface and a bottom surface, the frame being shaped for being received within the opening in the surface panel, and the at least one tab being bendable from an unbent position to a bent position in which the bent tab engages the bottom surface of the surface panel; and the at least one tab being weakened along a line off-set at an acute angle from vertical such that when the at least one tab is bent it bends along the line and it bears against the bottom surface of the surface panel to urge the frame against the surface panel.

2. The control panel mounting bracket of claim 1, wherein the frame is made of metal.

3. The control panel mounting bracket of claim 1, wherein the main securing member comprises a central portion extending substantially perpendicularly from the frame, and the at least one tab extends substantially planar from the central portion when the at least one tab is in the unbent position, and has a weakened connection along the line along which the tab is bent.

4. The control panel mounting bracket of claim 3, wherein the at least one tab comprises two tabs.

5. The control panel mounting bracket of claim 3, wherein the weakened connection is such that when the tab is bent, it moves in a direction to bear against the bottom surface of the surface panel.

6. The control panel mounting bracket of claim 3, wherein the central portion has a greater vertical dimension than the tab.

7. The control panel mounting bracket of claim 6, wherein the greater vertical dimension is about 3 millimeters.

8. A control mount assembly for a domestic appliance, comprising:

a frame shaped for being installed on a surface panel of a domestic appliance, the surface panel having an opening therein, and the frame having an open portion for receiving a control mount adhered over the open portion to the frame;

a main securing member having at least one tab extending from the main securing member, the main securing member extending from the frame for being received into the surface panel, and the surface panel having a top surface and a bottom surface, the frame being shaped for being received within the opening in the surface panel, and the at least one tab being bendable from an unbent position to a bent position in which the bent tab engages the bottom surface of the surface panel;

the at least one tab being weakened along a line off-set at an acute angle from vertical such that when the at least one tab is bent it bends along the line and it bears against the bottom surface of the surface panel to urge the frame against the surface panel; and a control mount adhered to the frame over the open portion of the frame, the control mount having openings for allowing control members of a domestic appliance to project therethrough for having control knobs mounted thereon.

9. The control mount assembly of claim 8, wherein the frame is made of metal.

10. The control mount assembly of claim 8, wherein the main securing member comprises a central portion extending substantially perpendicularly from the frame, and the at least one tab extends substantially planar from the central portion when the at least one tab is in the unbent position, and has a weakened connection along the line along which the tab is bent.

11. The control mount assembly of claim 10, wherein the at least one tab comprises two tabs.

12. The control mount assembly of claim 10, wherein the weakened connection is such that when the tab is bent, it moves in a direction to bear against the bottom surface of the surface panel.

13. The control mount assembly of claim 10, wherein the central portion has a greater vertical dimension than the tab.

14. The control mount assembly of claim 13, wherein the greater vertical dimension is about 3 millimeters.

15. A domestic appliance, comprising:

a surface panel having a top surface and a bottom surface and having an opening therein;

a frame shaped for being installed on the surface panel and having an open portion for receiving a control mount adhered over the open portion to the frame;

a main securing member having at least one tab extending from the main securing member, the main securing member extending from the frame for being received into the surface panel, the frame being shaped for being received within the opening in the surface panel, and the at least one tab being bendable from an unbent position to a bent position in which the bent tab engages the bottom surface of the surface panel;

the at least one tab being weakened along a line off-set at an acute angle from vertical such that when the at least one tab is bent it bends along the line and it bears against the bottom surface of the surface panel to urge the frame against the surface panel; and a control mount adhered to the frame over the open portion of the frame, the control mount having openings for allowing control members of the domestic appliance to project therethrough for having control knobs mounted thereon;

wherein the control mount and frame assembly are removeably attached to the surface panel of the domestic appliance.

16. The domestic appliance of claim 15, wherein the frame is made of metal.

17. The domestic appliance of claim 15, wherein the main securing member comprises a central portion extending substantially perpendicularly from the frame, and the at least one tab extends substantially planar from the central portion when the at least one tab is in the unbent position, and has a weakened connection along the line along which the tab is bent.

18. The domestic appliance of claim 17, wherein the at least one tab comprises two tabs.

19. The domestic appliance of claim 17, wherein the central portion has a greater vertical dimension than the tab.

20. The domestic appliance of claim 17, wherein the weakened connection is such that when the tab is bent, it moves in a direction to bear against the bottom surface of the surface panel.

5

* * * * *